US011713889B2

(12) United States Patent
Zhang et al.

(10) Patent No.: US 11,713,889 B2
(45) Date of Patent: Aug. 1, 2023

(54) WINDOW AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Kangwen Zhang, Foshan (CN); Zhigang Xing, Foshan (CN); Zhisheng Lei, Foshan (CN); Yu Liu, Foshan (CN); Hui Yu, Foshan (CN); Yuhang Tang, Foshan (CN); Wenjun Shen, Foshan (CN); Ali Zhao, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 433 days.

(21) Appl. No.: 16/914,732

(22) Filed: Jun. 29, 2020

(65) Prior Publication Data

US 2021/0207819 A1 Jul. 8, 2021

Related U.S. Application Data

(63) Continuation of application No. PCT/CN2020/077785, filed on Mar. 4, 2020.

(30) Foreign Application Priority Data

Jan. 8, 2020 (CN) ..... 202010020564.7
Jan. 8, 2020 (CN) ..... 202020037886.8

(51) Int. Cl.

| | |
|---|---|
| ***F24F 1/031*** | (2019.01) |
| ***F24F 13/32*** | (2006.01) |
| ***F24F 13/20*** | (2006.01) |

(52) U.S. Cl.
CPC ..... *F24F 1/031* (2019.02); *F24F 13/20* (2013.01); *F24F 13/32* (2013.01); *F24F 2221/20* (2013.01)

(58) Field of Classification Search
CPC ..... F24F 1/031; F24F 13/32; F24F 2221/20; F24F 1/027; F24F 1/02; F24F 7/013;
(Continued)

(56) References Cited

U.S. PATENT DOCUMENTS 3,587,441 A * 6/1971 Woods ..... F24F 1/04 454/203
5,295,903 A 3/1994 Bolton et al.
(Continued)

FOREIGN PATENT DOCUMENTS

CN 102455025 A 5/2012
CN 103836784 A 6/2014
(Continued)

OTHER PUBLICATIONS

Canadian Intellectual Property Office the Office Action for CA Application No. 3085727 dated Aug. 26, 2021 5 Pages.
(Continued)

*Primary Examiner* — Travis Ruby
*Assistant Examiner* — Christopher C Pillow
(74) *Attorney, Agent, or Firm* — Anova Law Group PLLC

(57) ABSTRACT

A window air conditioner includes a casing and a positioning member provided at the casing and configured to be switchable between a storage state and a working state. In the storage state, the positioning member is stored at the casing. In the working state, the positioning member is at least partially outside the casing for connecting and positioning the casing with a window frame.

19 Claims, 10 Drawing Sheets

(58) Field of Classification Search
CPC ..... F24F 13/18; E06B 3/48; E06B 3/4609; E06B 3/4618; E06B 3/4627; E06B 7/16
See application file for complete search history.

(56) References Cited

U.S. PATENT DOCUMENTS

| | | | | |
|---|---|---|---|---|
| 2015/0097096 | A1 | 4/2015 | Arbucci | |
| 2017/0191679 | A1* | 7/2017 | Xu | F24F 13/32 |
| 2018/0023842 | A1 | 1/2018 | Gardikis et al. | |
| 2019/0056143 | A1* | 2/2019 | Zhang | F24F 13/32 |
| 2019/0231071 | A1* | 8/2019 | Smith | A47B 88/407 |
| 2019/0331362 | A1* | 10/2019 | Gao | F24F 13/32 |

FOREIGN PATENT DOCUMENTS

| | | | | | |
|---|---|---|---|---|---|
| CN | 206959300 | U | | 2/2018 | |
| CN | 108870565 | A | * | 11/2018 | F24F 1/027 |
| CN | 209689079 | U | | 11/2019 | |
| CN | 209706234 | U | | 11/2019 | |
| CN | 209763324 | U | | 12/2019 | |

OTHER PUBLICATIONS

Canadian Intellectual Property Office the Office Action for CA Application No. 3085727 dated Mar. 3, 2022 4 Pages.
World Intellectual Property Organization (WIPO) International Search Report and Written Opinion for PCT/CN2020/077785 with translation dated Sep. 30, 2020 16 Pages.

* cited by examiner

WINDOW AIR CONDITIONER

CROSS-REFERENCE TO RELATED APPLICATIONS

This application is a continuation of International Application No. PCT/CN2020/077785, filed on Mar. 4, 2020, which claims the benefit of priority to Chinese Patent Application No. 202010020564.7, filed on Jan. 8, 2020 and entitled "Window Air Conditioner," and Chinese Patent Application No. 202020037886.8, filed on Jan. 8, 2020 and entitled "Window Air Conditioner," the entire contents of all of which are incorporated herein by reference.

FIELD

The present disclosure relates to the technical field of air conditioners, and in particular to a window air conditioner.

BACKGROUND

In the related art, a window air conditioner is usually placed directly at a window frame of a wall without being fixed. When the shielding member (such as sashes, window shutters, curtains, etc.) at the window frame are opened, the window air conditioner is directly exposed at the window frame with a larger space. When the window air conditioner is subjected to external force from the user or an external object, it is prone to move, and then rolls over to the outdoor side or indoor side, which leads to a potentially large safety issue.

SUMMARY

The main object of this disclosure is to provide a window air conditioner, which aims to improve the installation stability of the window air conditioner, so as to reduce the occurrence of rollover of the window air conditioner, thereby reducing safety risks.

In order to achieve the above object, the present disclosure provides a window air conditioner, including a casing; and a positioning member provided at the casing and configured to be switchable between a storage state and a working state; and, where: in the storage state, the positioning member is stored at the casing; and in the working state, the positioning member extends from a lateral side of the casing for connecting and fixing the casing with a window frame.

In some embodiments, the window air conditioner further includes: a divider slot formed at the casing and configured for a shielding member at the window frame to extend into; and, where: the positioning member is configured to be mounted at the divider slot to be stored in the divider slot in the storage state.

In some embodiments, the positioning member is configured to be rotatably mounted at the divider slot to switch a state by rotation; or the positioning member is configured to be slidably mounted at the divider slot to switch a state by sliding; or the positioning member is configured to be pullably mounted at the divider slot to switch a state by sliding.

In some embodiments, the window air conditioner further includes: a divider provided at a bottom of the divider slot, the divider includes an accommodation cavity extending in a length direction of the divider and the accommodation cavity have openings at two ends, respectively; and, where: the positioning member is configured to be pullably mounted at the accommodation cavity from at least one opening of the accommodation cavity.

In some embodiments, at least two positioning members are provided, the at least two positioning members being configured to be pullably mounted at the accommodation cavity from the two ends of the accommodation cavity and be arranged in a stacked status in the storage state.

In some embodiments, the positioning member includes: a main plate; and two side edge plates, one of the two side edge plates being arranged at one side of the main plate, the other one of the two side edge plates being arranged at the other side of the main plate; and, where: the two side edge plates and the main plate are configured to be enclosed to form a recess, one side edge plate of one of the at least two positioning members being configured to be inserted into the recess of another one of the at least two positioning members to arrange the at least two positioning members in the stacked status in an up and down direction; or one of the two positioning members has a cavity, the other one of the two positioning members being configured to be inserted into the cavity to arrange the two positioning members in the stacked status in an inner and outer direction in the storage state.

In some embodiments, the accommodation cavity is formed inside the divider; and the divider is hollowed in a top wall of the accommodation cavity to form openings.

In some embodiments, the divider has an alignment hole at an end; the positioning member has positioning holes arranged at intervals along a length direction of the positioning member; and the positioning member is configured to be fixed at the casing by a connector sequentially passing through one of the positioning holes and the alignment hole.

In some embodiments, each positioning hole is configured to be in an elongated shape extending along the length direction of the positioning member.

In some embodiments, the window air conditioner further includes: an insertion connector formed at an end of the positioning member and configured to be correspondingly inserted into and connected with an insertion slot on the window frame.

In some embodiments, the window air conditioner further includes: a seal movably mounted at the divider slot and configured to extend from a lateral side of the divider slot by moving for the shielding member and/or an inner wall of the window frame to abut against.

In some embodiments, the window air conditioner further includes: a mounting base; and, where: the seal is configured to be rotatably mounted at the divider slot through the mounting base; the seal is configured to be inserted into and connected with the mounting base; and the seal is configured to be fixed in an interference fit with the mounting base through deformation.

In some embodiments, the mounting base includes: a bottom plate, including: a rotation arm rotatably connected with the divider slot formed at one end of the bottom plate; and two side plates, one of the two side plates being arranged at a side of the bottom plate, the other one of the two side plates being arranged at the other opposite side of the bottom plate; and, where: the bottom plate and the two side plates are configured to form a mounting slot for the seal to be inserted into.

In some embodiments, the window air conditioner further includes: a guide protrusion protruding from an inner wall of at least one of the two side plates, the guide protrusion being configured to be in an elongated shape extending along an insertion direction of the mounting slot.

In some embodiments, the seal is made of a flexible material to be flexibly deformable; or the seal is made of an elastic material to be elastically deformable.

In some embodiments, the seal is cuttable to change a length of the seal.

In some embodiments, in the working state, the positioning member is configured to abut against a top surface of the seal and extend along a same extension direction as the seal to press the seal against the window frame.

In some embodiments, the window air conditioner further includes: a sink slot formed at an end of the divider in the divider slot and configured for the seal to be movably installed; and an avoiding slot formed at an outer side wall of the sink slot and corresponding to the mounting slot, the avoiding slot being configured to avoid the positioning member when the positioning member switches a state.

In the technical solution of the present disclosure, a positioning member is provided at the casing of the window air conditioner, the positioning member has a storage state and a working state, and the positioning member can be switched between the storage state and the working state. The positioning member may be switched to the working state when the window air conditioner is installed for use. The outer end of the positioning member is connected and fixed to the window frame, so as to fix the window air conditioner to the window frame. Thus, the installation of window air conditioner is firm and stable, and it is not prone to roll over to the indoor or outdoor side. The positioning member may be switched to the storage state when the window air conditioner is transported or stored, so as to reduce the lateral space of the window air conditioner that occupied by the positioning member, which is convenient for the transportation or storage of the window air conditioner.

BRIEF DESCRIPTION OF THE DRAWINGS

In order to explain the technical solutions in the embodiments of the present disclosure more clearly, the drawings used in the description of the embodiments will be briefly introduced below. Obviously, the drawings in the following description are merely some embodiments of the present disclosure. For those of ordinary skill in the art, other drawings can be obtained according to the structure shown in the drawings without paying creative labor.

DESCRIPTION OF REFERENCE NUMERALS

Figure 1:
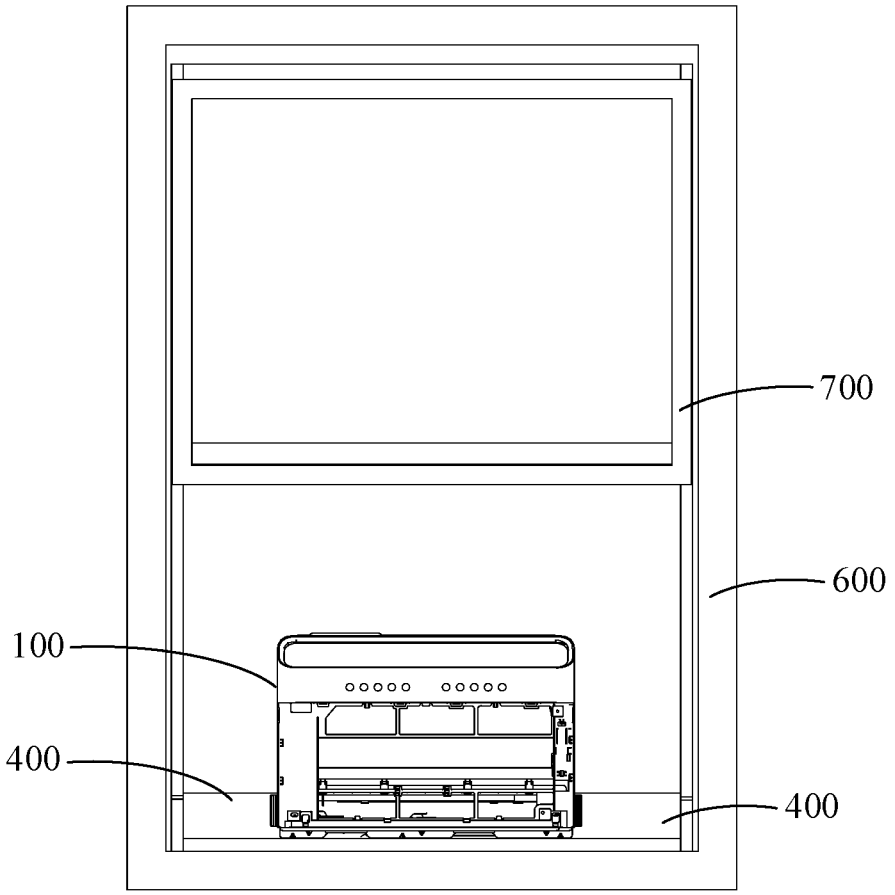
FIG. 1 is a schematic diagram of a window air conditioner mounted at a window frame of the present disclosure.

| Reference Numeral | Name |
|---|---|
| 100 | Window air conditioner |
| 110 | Casing |
| 111 | Indoor casing |
| 112 | Outdoor casing |
| 113 | Divider slot |
| 200 | Divider |
| 210 | Accommodation cavity |
| 220 | See through opening |
| 230 | Alignment hole |
| 240 | Sink slot |
| 250 | Avoiding slot |
| 300 | Positioning member |
| 310 | Main plate |
| 311 | Positioning hole |
| 320 | Side edge plate |
| 330 | Insertion connector |
| 400 | Seal |
| 410 | Boss |
| 420 | Accommodation slot |
| 500 | Mounting base |
| 510 | Bottom plate |
| 511 | Rotation arm |
| 520 | Side plate |
| 521 | Guide protrusion |
| 530 | Mounting slot |
| 600 | Window frame |
| 610 | Insertion slot |
| 700 | Shielding member |

The purpose, function characteristics, and advantages of the present disclosure will be further described with reference to the embodiments and the accompanying drawings.

DETAILED DESCRIPTION OF THE EMBODIMENTS

The technical solutions in the embodiments of the present disclosure will be clearly and completely described below with reference to the drawings in the embodiments of the present disclosure. Obviously, the described embodiments are only a part of the embodiments of the present disclosure, but not all of the embodiments. Based on the embodiments in the present disclosure, all other embodiments obtained by a person of ordinary skill in the art without creative efforts shall fall within the protection scope of the present disclosure.

It should be noted that if there is a directional indicator (such as up, down, left, right, front, back, etc.) in the embodiments of the present disclosure, the directional indication is only used to explain the relative positional relationship, movement, etc. of the various components in a specific posture (as shown in the drawings), if the specific posture changes, the directional indicator will change accordingly.

In addition, if there are descriptions related to "first," "second," etc. in the embodiments of the present disclosure, the descriptions of "first," "second," etc. are only used for description purposes, and cannot be understood to indicate or imply its relative importance or to imply the number of technical features indicated. Therefore, the features as associated with "first" and "second" may explicitly or implicitly include at least one of the features. In addition, the technical solutions between the various embodiments can be combined with each other as long as they do not conflict with each other.

As shown in FIG. 1, this disclosure provides embodiments of a window air conditioner, which can be mounted at a window frame of a wall to cool or heat an indoor environment. The window air conditioner is mounted at the window frame with high stability, and it is not prone to roll over.

Figure 2:
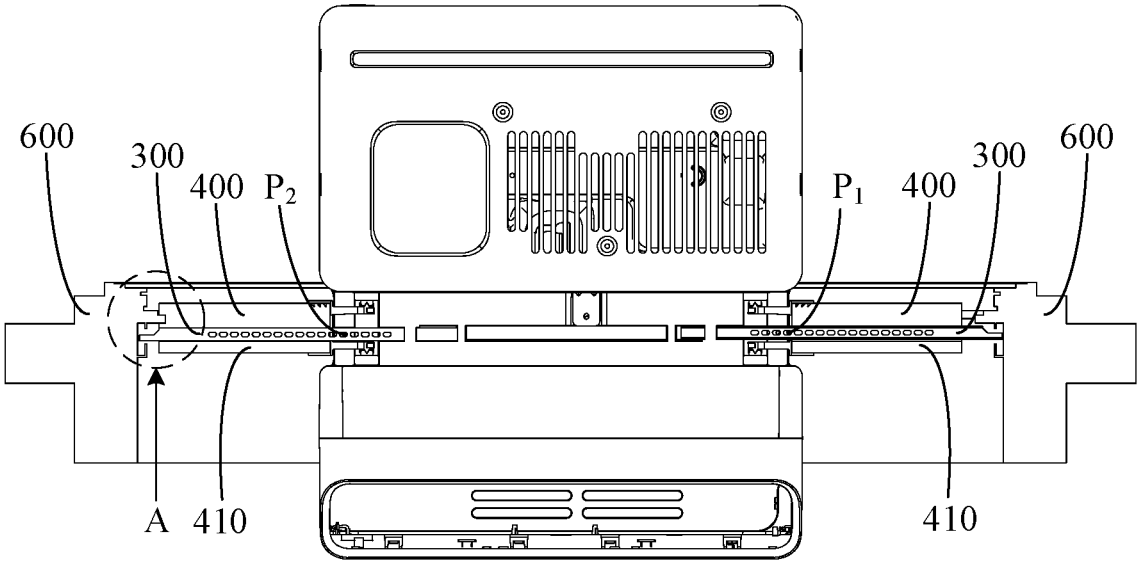
FIG. 2 is a top view of the window air conditioner mounted at the window frame in FIG. 1.
Figure 3:
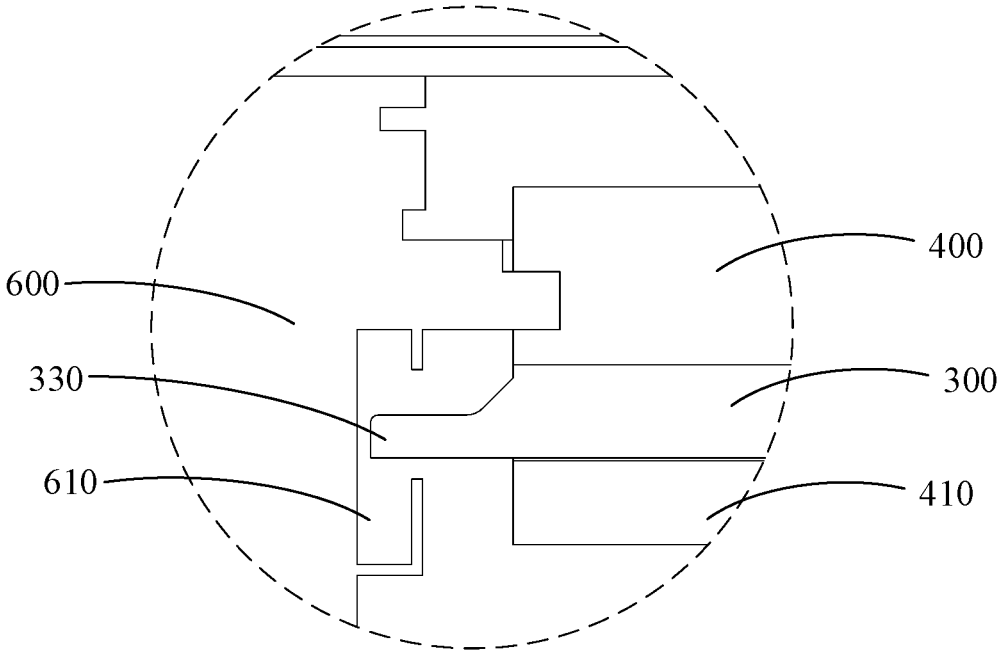
FIG. 3 is an enlarged view of a portion A in FIG. 2.

As shown in FIGS. 1 to 2, in an embodiment of the window air conditioner 100 according to the present disclosure, the window air conditioner 100 includes a casing 110 and a positioning member 300. The positioning member 300 is provided at the casing 110 and configured to be switchable between a storage state and a working state. In the storage state, the positioning member 300 is configured to be stored at the casing 110; and in the working state, the positioning member 300 is configured to extend from a lateral side of the casing 110 for connecting and positioning the casing 110 with a window frame 600 (as shown in FIGS. 2 to 3).

Specifically, the structure of the positioning member 300 is not specifically limited. For example, the positioning member 300 may be provided in an elongated shape, a rod shape or a plate shape. The positioning member 300 may be a plastic member or a sheet metal member, and may be specifically selected according to strength requirements. When the positioning member 300 is in the storage state, the positioning member 300 may be stored at a side wall of the casing 110 or may be stored inside the casing 110. When the positioning member 300 is in the working state, the positioning member 300 may be connected and fixed to a side frame plate or a bottom frame plate of the window frame 600. As for the connecting and fixing method, there may be various design methods, such as, but not limited to, the positioning member 300 and the window frame 600 may be connected and fixed through a screw structure or may be inserted and fixed through an insertion slot 610 structure.

In the technical solution of the present disclosure, a positioning member 300 is provided at the casing 110 of the window air conditioner 100, the positioning member 300 has a storage state and a working state, and the positioning member 300 can be switched between the storage state and the working state. The positioning member 300 may be switched to the working state when the window air conditioner 100 is installed for use. The outer end of the positioning member 300 is connected and fixed to the window frame 600, so as to fix the window air conditioner 100 to the window frame 600. Thus, the installation of window air conditioner 100 is firm and stable, and it is not prone to roll over to the indoor or outdoor side. The positioning member 300 may be switched to the storage state when the window air conditioner 100 is transported or stored, so as to reduce the lateral space of the window air conditioner 100 that occupied by the positioning member 300, which is convenient for the transportation or storage of the window air conditioner 100.

Figure 4:
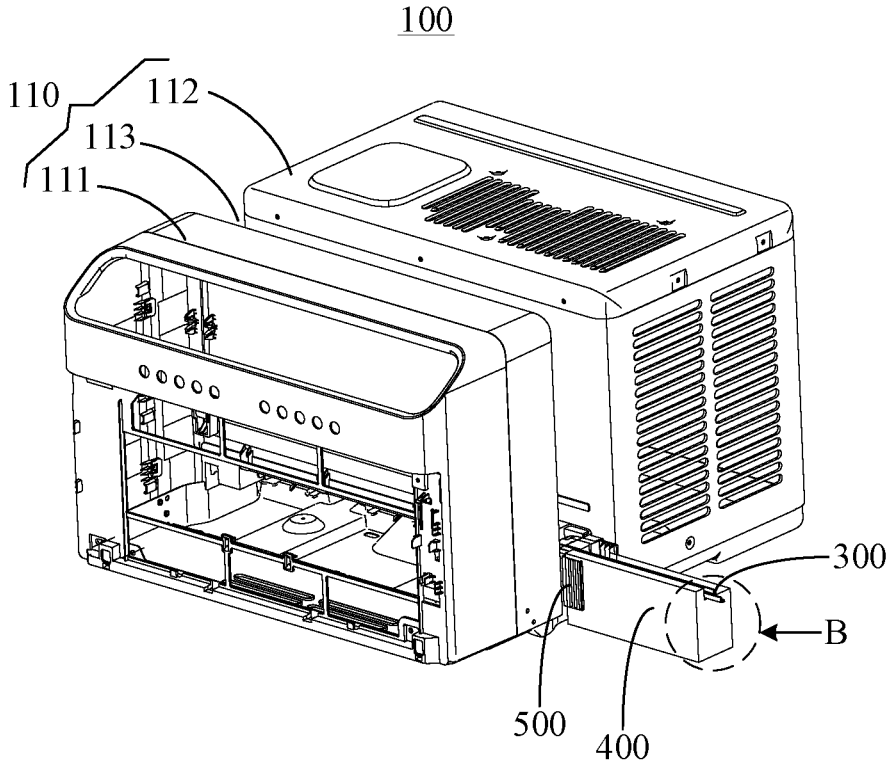
FIG. 4 is a schematic structural diagram of the window air conditioner in FIG. 2.
Figure 5:
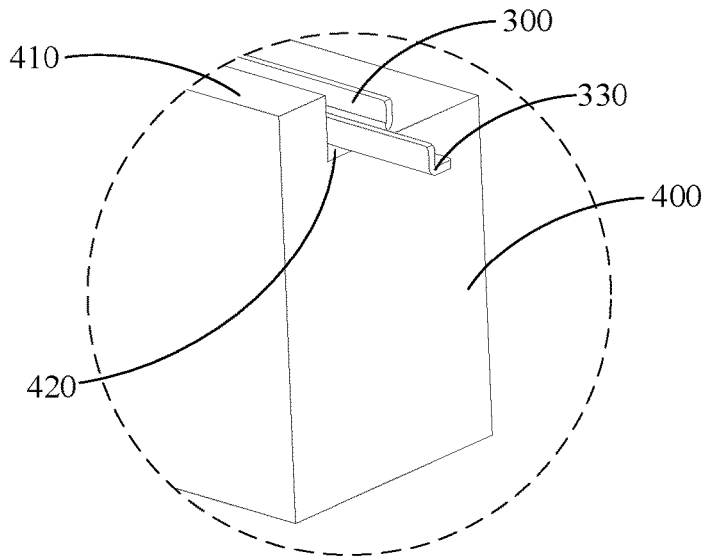
FIG. 5 is an enlarged view of a portion B in FIG. 4.

As shown in FIG. 2 and FIG. 4, in an embodiment, a divider slot 113 is formed at the casing 110 and configured for a shielding member 700 at the window frame 600 to extend into. The divider slot 113 divides the casing 110 into an indoor casing 111 and an outdoor casing 112. An indoor unit (such as an indoor heat exchanger and an indoor fan) is mounted at the indoor casing 111, and an outdoor unit (such as an outdoor heat exchanger and an outdoor fan) is mounted at the outdoor casing 112. The divider slot 113 may block the noise generated by the outdoor environment or the outdoor unit, reduce the transmission of such noise to the indoor room, which is conducive to the noise reduction. It should be noted that the shielding member 700 may block light, and the shielding member 700 may be window sashes, window shutters, or curtains, or other protective window panels that can block external objects from entering the room.

Based on this, in order to facilitate the storage of the positioning member 300, the positioning member 300 may be mounted at the divider slot 113 to be stored in the divider slot 113 in the storage state, so that the space of the divider slot 113 may be fully utilized without configuring additional space on the casing 110 for store the positioning member 300. Certainly, in other embodiments, a storage space for storing the positioning member 300 may also be arranged at the side wall or inside the casing 110.

Referring to FIG. 2 and FIG. 4, for the manner in which the positioning member 300 is mounted at the divider slot 113, the positioning member 300 may be detachably mounted at the divider slot 113. When the positioning member 300 needs to be used, the positioning member 300 is provided at the casing 110. After the positioning member 300 is mounted, the positioning member 300 is directly in the working state. When the positioning member 300 is not needed, the positioning member 300 may be removed from the casing 110 and placed in the divider slot 113 to be switched to the storage state.

In addition to the above-mentioned mounting manner, the manner in which the positioning member 300 is mounted at the divider slot 113 may also be a manner in which the positioning member 300 is movably mounted at the divider slot 113. When the positioning member 300 needs to be used, the positioning member 300 is moved to extend from a lateral side of the casing 110 to switch to the working state. When the positioning member 300 is not needed, the positioning member 300 is moved to be stored in the divider slot 113 to switch to the storage state. As for the movable mounting method of the positioning member 300, there are also various design types, examples of which are described below.

In an embodiment, the positioning member 300 is rotatably mounted at the divider slot 113 to switch a state by rotation. For example, one end of the positioning member 300 is rotatably mounted at the divider slot 113, and the positioning member 300 may be switched between the storage state and the working state by turning it inside and outside the divider slot 113.

In another embodiment, the positioning member 300 is slidably mounted at the divider slot 113 to switch a state by sliding. For example, a slide rail extending along a length of the divider slot 113 is formed at the bottom of the divider slot 113, and the positioning member 300 is slidably fitted with the slide rail, so that the positioning member 300 may be slid along the inside and outside the divider slot 113 to switch between the storage state and the working state.

In still another embodiment, the positioning member 300 is pullably mounted at the divider slot 113 to switch a state by sliding. For example, an accommodation cavity 210 extending along a length direction of the divider slot 113 is formed at the bottom of the divider slot 113, and then the positioning member 300 is pullably mounted at the accommodation cavity 210 (similar to the installation method of a drawer), so that the positioning member 300 may be pulled along the inside and outside the divider slot 113 to switch between the storage state and the working state.

Figure 6:
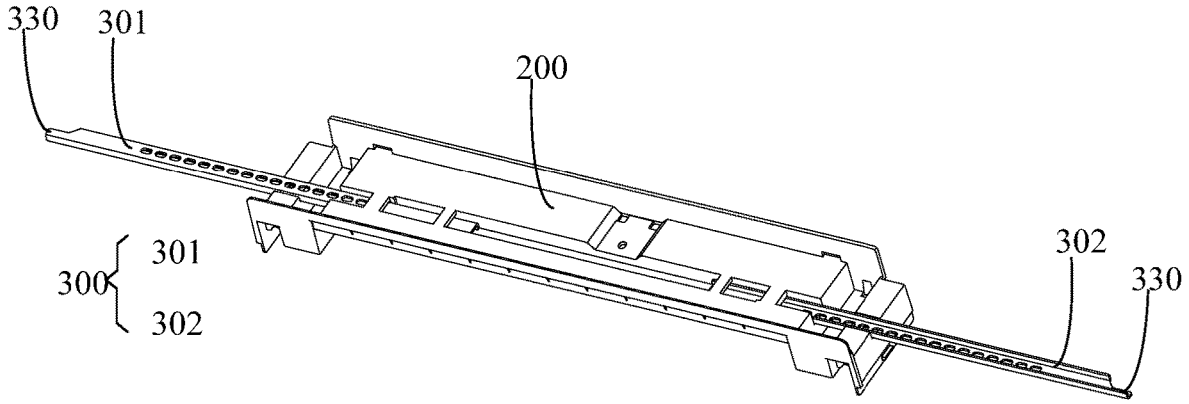
FIG. 6 is a schematic diagram of a positioning member provided at a divider in FIG. 4 in a working state.
Figure 7:
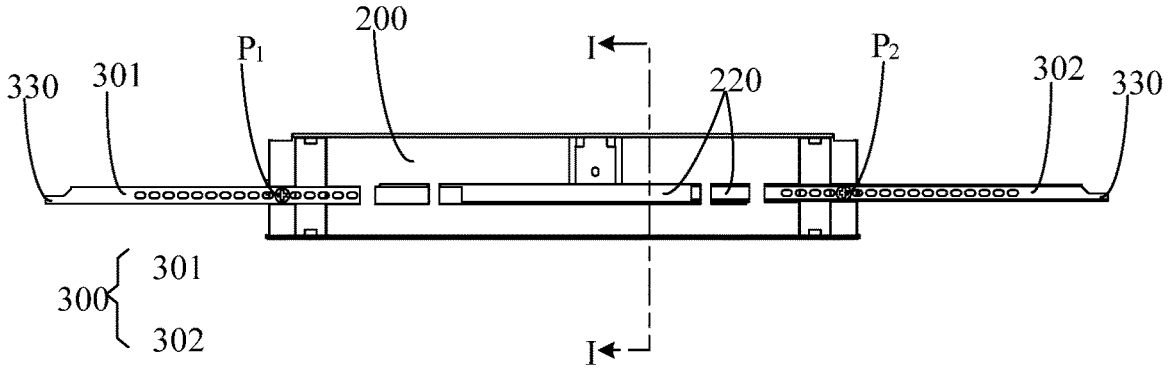
FIG. 7 is a top view of the divider and the positioning member in FIG. 6.
Figure 8:
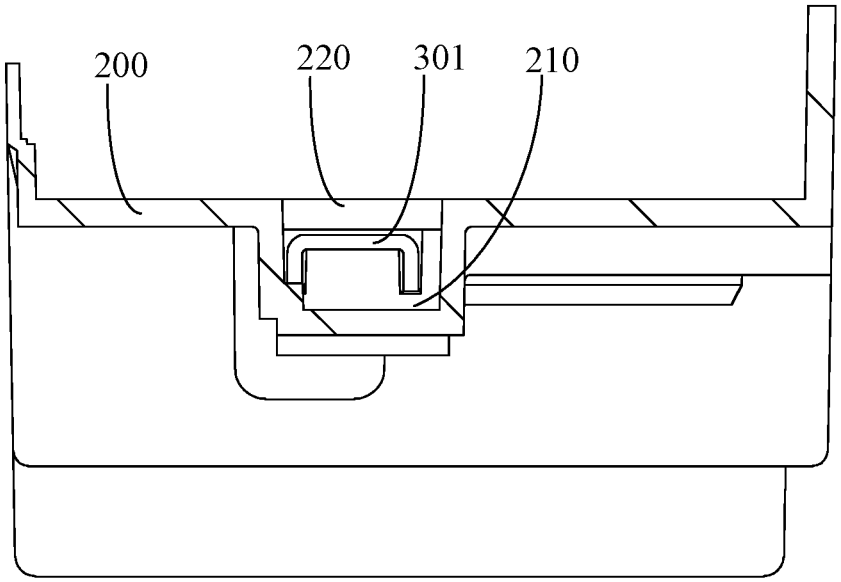
FIG. 8 is a cross-sectional view taken along a line I-I in FIG. 7.

Specifically, the positioning member 300 may be mounted by using the method in the latter embodiment, that is, the positioning member 300 is pullably mounted at the divider slot 113. Referring to FIG. 2, the window air conditioner 100 further includes a divider 200 provided at the bottom of the divider slot 113. The divider 200 is configured to be abutted against by the shielding member 700. As shown in FIGS. 6 to 8, optionally, in order to facilitate the pullable mounting of the positioning member 300, an accommodation cavity 210 extending in a length direction of the divider 200 is formed inside the divider 200. The accommodation cavity 210 have openings at two ends, respectively. The positioning member 300 is configured to be pullably mounted at the accommodation cavity 210 from at least one opening of the accommodation cavity 210.

As shown in FIGS. 6 to 8, when the window air conditioner 100 is mounted at the window frame 600, and the window air conditioner 100 needs to be fixed by using the positioning member 300, the positioning member 300 may be pulled out from a lateral side of the accommodation cavity 210 of the divider 200 until an outer end of the positioning member 300 abuts against the window frame 600 (at this time, an inner end of the positioning member 300 is still inserted into the accommodation cavity 210), and then the positioning member 300 is connected and fixed to the window frame 600 (such as by screwing), so as to fix the window air conditioner 100 at the window frame 600.

Figure 9:
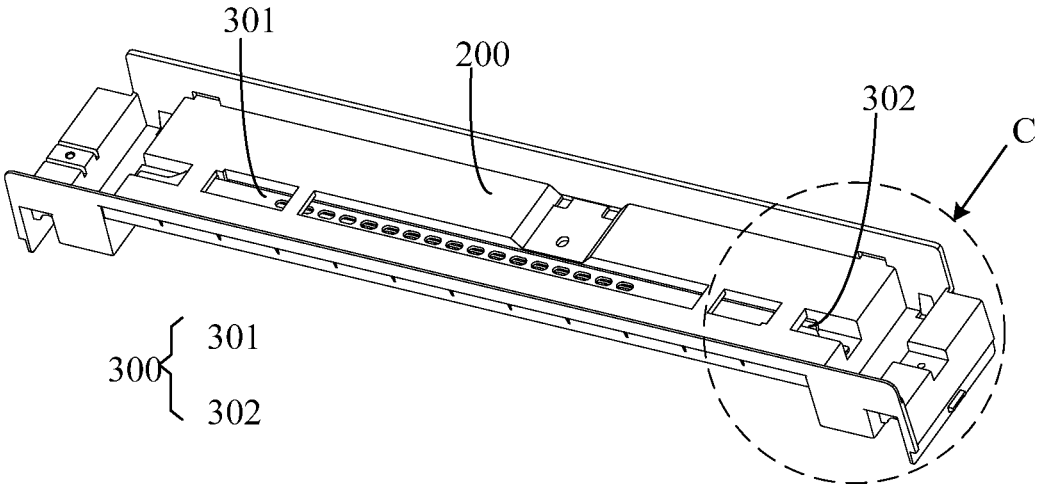
FIG. 9 is a schematic diagram of the positioning member provided at the divider in FIG. 6 switched to a storage state.
Figure 11:
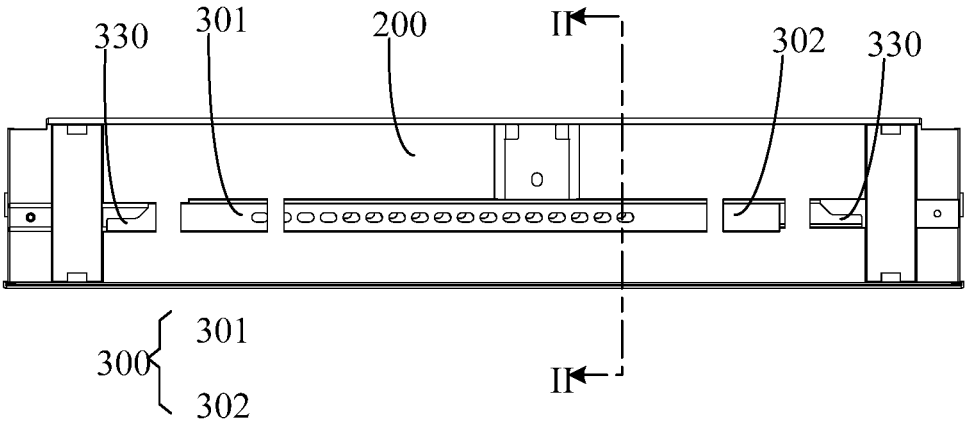
FIG. 11 is a top view of the divider and the positioning member in FIG. 9.
Figure 12:
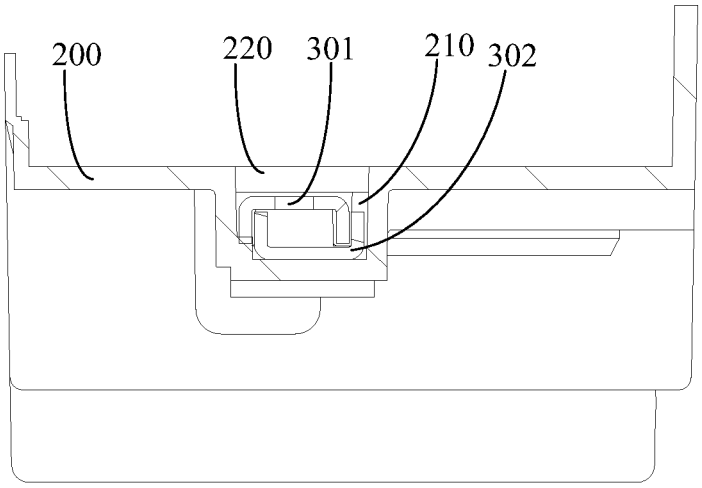
FIG. 12 is a cross-sectional view taken along a line II-II in FIG. 11.

As shown in FIG. 9, FIG. 11, and FIG. 12, when the window air conditioner 100 is transported or stored, the positioning member 300 is not needed, and then the positioning member 300 may be inserted into the accommodation cavity 210, that is, the positioning member 300 is stored inside the divider 200 to be in the storage state.

To ensure the installation stability of the window air conditioner 100, optionally, at least two positioning members 300 are provided. The structures of the at least two positioning members 300 may be the same or different. When the structures of the at least two positioning members 300 are the same, the at least two positioning members 300 may be made into standard parts, so that the same mold can be used for manufacturing, which is conducive to mass production and manufacturing. Here, two positioning members 300 are taken as an example. The two positioning members 300 are pullably mounted at the accommodation cavity 210 from two ends of the accommodation cavity 210, respectively.

For the convenience of description, the two positioning members 300 are referred to as: a first positioning member 301 and a second positioning member 302. When in use, the first positioning member 301 and the second positioning member 302 are respectively pulled out from opposite ends of the accommodation cavity 210 in opposite directions to be connected and fixed to the frame plates on opposite sides of the window frame 600, respectively. At this time, both the first positioning member 301 and the second positioning member 302 are in the working state. When not in use, the first positioning member 301 and the second positioning member 302 are respectively inserted from the two ends of the accommodation cavity 210 facing one another, so as to be stored back to the inside of the accommodation cavity 210. At this time, both the first positioning member 301 and the second positioning member 302 are in the storage state.

Figure 13:
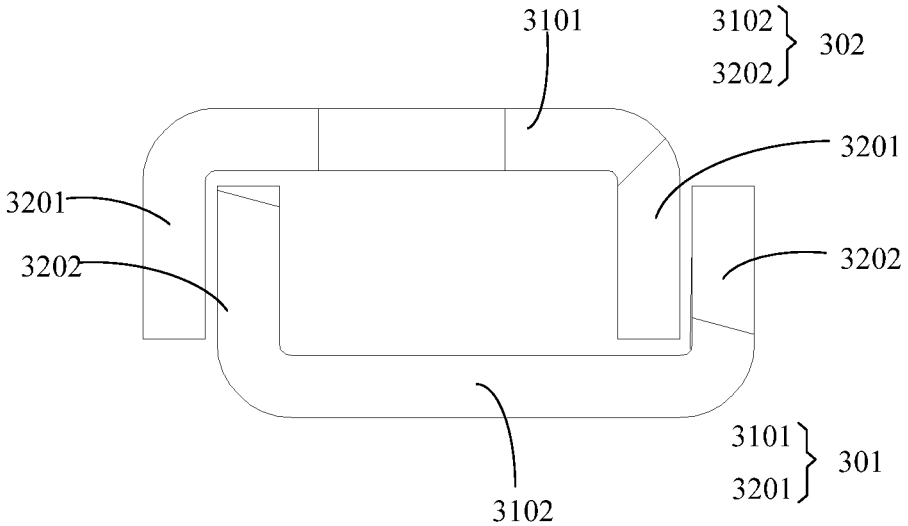
FIG. 13 is a schematic diagram showing two positioning members stacked in an up-down direction in FIG. 12.

As shown in FIG. 12 and FIG. 13, in an embodiment, because the space of the accommodation cavity 210 on the divider 200 is relatively narrow, it is not prone to receive the two positioning members 300 side by side. Therefore, in order to reduce the storage space required for the two positioning members 300, the two positioning members 300 may be arranged in a stacked status in the storage state. In this way, the lateral space occupied by the two positioning members 300 may be reduced, and the two positioning members 300 may be conveniently stored in the accommodation cavity 210 of the divider 200.

For the specific manner of placing the two positioning members 300 in the stacked status in the storage state, the corresponding design can be made according to the structures of the two positioning members 300. Specifically, the positioning member 300 includes: a main plate 310; and two side edge plates 320, one of the two side edge plates 320 being arranged at one side of the main plate 310, the other one of the two side edge plates 320 being arranged at the other side of the main plate 310 (see FIGS. 14 and 15 for details). The two side edge plates 320 and the main plate 310 are configured to be enclosed to form a recess, one side edge plate 320 of one of the two positioning members 300 being configured to be inserted into the recess of the another one of the two positioning members 300 to arrange the two positioning members 300 in the stacked status in an up and down direction.

For convenience of description, in FIGS. 13, 3101 and 3201 are respectively shown as the main plate and the side edge plate of the first positioning member 301; and 3102 and 3202 are respectively shown as the main plate and the side edge plate of the second positioning member 302. When the first positioning member 301 and the second positioning member 302 are being stored, the first positioning member 301 is inserted from one end of the accommodation cavity 210, and at this time, the recess of the first positioning member 301 is opened downward; and the second positioning member 302 is inserted from the other end of the accommodation cavity 210, and the recess of the second positioning member 302 is opened upward. Until the first positioning member 301 and the second positioning member 302 meet, one of the side edge plates 3201 of the first positioning member 301 fits into the recess of the second positioning member 302. Accordingly, one of the side edge plates 3202 of the second positioning member 302 also correspondingly fits into the recess of the first positioning member 301, and continues to push the first positioning member 301 and the second positioning member 302 to stack the first positioning member 301 and the second positioning member 302 (namely in the stacked status in an up and down direction).

Here, since the accommodation cavity 210 is formed inside the divider 200, when the two positioning members 300 are stored, it is inconvenient to check whether the inner ends of the two positioning members 300 fit accurately, so that it is not easy to stack the two positioning members 300. In order to solve this problem, see through openings 220 (as shown in FIGS. 9 to 12) may be hollowed in a top wall of the accommodation cavity 210 on the divider 200, so that the inside of the accommodation cavity 210 may be viewed through the see through openings 220, and then it is checked whether the inner ends of the two positioning members 300 fit accurately. If not, the positions of the two positioning members 300 may be fine-tuned, so that the two positioning members 300 may stack together, thereby greatly reducing difficulty of storing the two positioning members 300.

In other embodiments, in addition to the manner in which the two positioning members 300 are arranged in the stacked status in an up and down direction, a cavity may be formed at one of the two positioning members 300, so that, in the storage state, the other one of the two positioning members 300 is inserted into the cavity to arrange the two positioning members 300 in the stacked status in an inner and outer direction. For example, one of the two positioning members 300 is hollow to form a cavity, so that the other one of the two positioning members 300 may be inserted into the cavity of the former positioning member 300, and the two positioning members 300 are stacked inside and outside.

Figure 14:
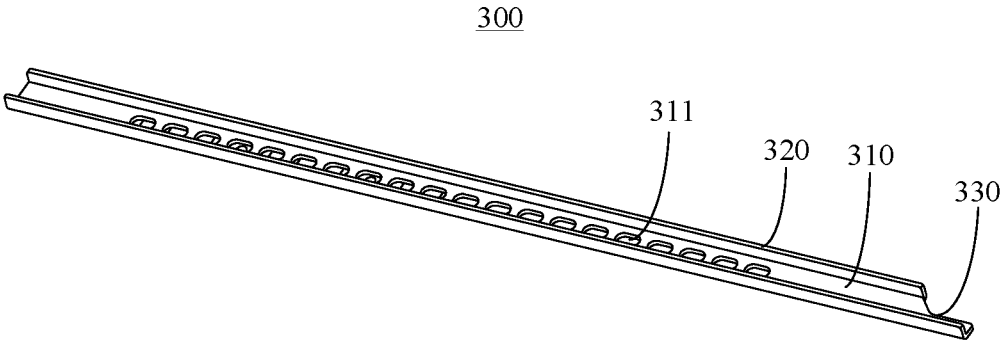
FIG. 14 is a schematic structural diagram of the positioning member of the present disclosure.

Referring to FIG. 2, FIG. 3, and FIG. 14, based on any one of the above embodiments, in order to facilitate the connection of the positioning member 300 with the window frame 600, an insertion connector 330 is formed at an end of the positioning member 300 and configured to be correspondingly inserted into and connected with an insertion slot 610 on the window frame 600. Specifically, the outer end of the positioning member 300 may be cut to form a tip, and the tip forms an insertion connector 330. In this way, the insertion connector 330 is smaller in size and easier to align with the insertion slot 610 of the window frame 600. This insertion connection method requires no screws and is easy to install and operate. The insertion slot 610 on the window frame 600 may be an additional inserting hole formed at the window frame 600; it may also be a slide slot on the window frame 600 for the shielding member 700 to slide up and down, so that it is not necessary to open an additional insertion slot.

In theory, in the working state of the positioning member 300, the inner end of the positioning member 300 is inserted and located in the accommodation cavity 210, and the outer end of the positioning member 300 is inserted into the window frame 600 to connect and locate the window air conditioner 100 to the window frame 600. However, in order to ensure the firmness of the inner end of the positioning member 300 inserted and located in the accommodation cavity 210 in its working state, a connecting member (such as a screw) may be used to connect and fix the inner end of the positioning member 300 to the casing 110 or the divider 200. However, because the size of the window frame 600 is usually inconsistent for different buildings, it is also necessary to adaptively adjust the extension length of the positioning member 300 of the window air conditioner 100, that is, to adjust the position where the positioning member 300 is connected and fixed to the casing 110 or the divider 200.

Referring to FIG. 6, FIG. 7, and FIG. 14, an example with the position where the positioning member 300 and the divider 200 are connected and fixed being adjustable is described. In order to achieve this purpose, the divider 200 has an alignment hole 230 at an end; the positioning member 300 has positioning holes 311 arranged at intervals along a length direction of the positioning member 300; and the positioning member 300 is configured to be fixed at the casing 110 by a connector sequentially passing through one of the positioning holes 311 and the alignment hole 230. The connecting member may be a screw.

When the window air conditioner 100 is fixed to the window frame 600, the lengths of the two positioning members 300 (i.e., the first positioning member 301 and the second positioning member 302) are adjusted laterally so that the two positioning members 300 and the corresponding insertion slots 610 of the window frame 600 may be inserted and connected. At this time, one of the positioning holes 311 of the positioning member 300 corresponds to the alignment hole 230 on the divider 200, and then the positioning hole 311 and the alignment hole 230 are correspondingly connected and fixed through a connecting member passing through. As shown in FIG. 7, P1 indicates a position where the first positioning member 301 and the divider 200 are connected and fixed by using a connecting member, and P2 indicates a position where the second positioning member 302 and the divider 200 are connected and fixed by using a connecting member.

Figure 15:
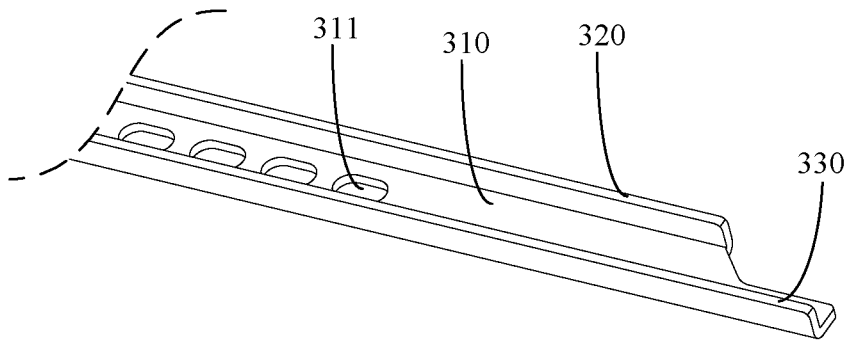
FIG. 15 is a schematic structural diagram of a portion of the positioning member in FIG. 14.

Because of the possibility of error, the positioning hole 311 on the positioning member 300 and the alignment hole 230 on the divider 200 may not completely correspond to each other. At this time, it is difficult for the connecting member to pass through the positioning hole 311 and the alignment hole 230 sequentially. Therefore, in order to solve this problem, the positioning hole 311 is provided in an elongated shape extending along the length direction of the positioning member 300 (the positioning hole 311 is shown in FIG. 15). Compared with the alignment hole 230, the positioning hole 311 has a margin along its length. This margin may compensate for the misalignment between the positioning hole 311 and the alignment hole 230 caused by the error, and improve the accuracy of the alignment between the positioning hole 311 and the alignment hole 230.

Figure 16:
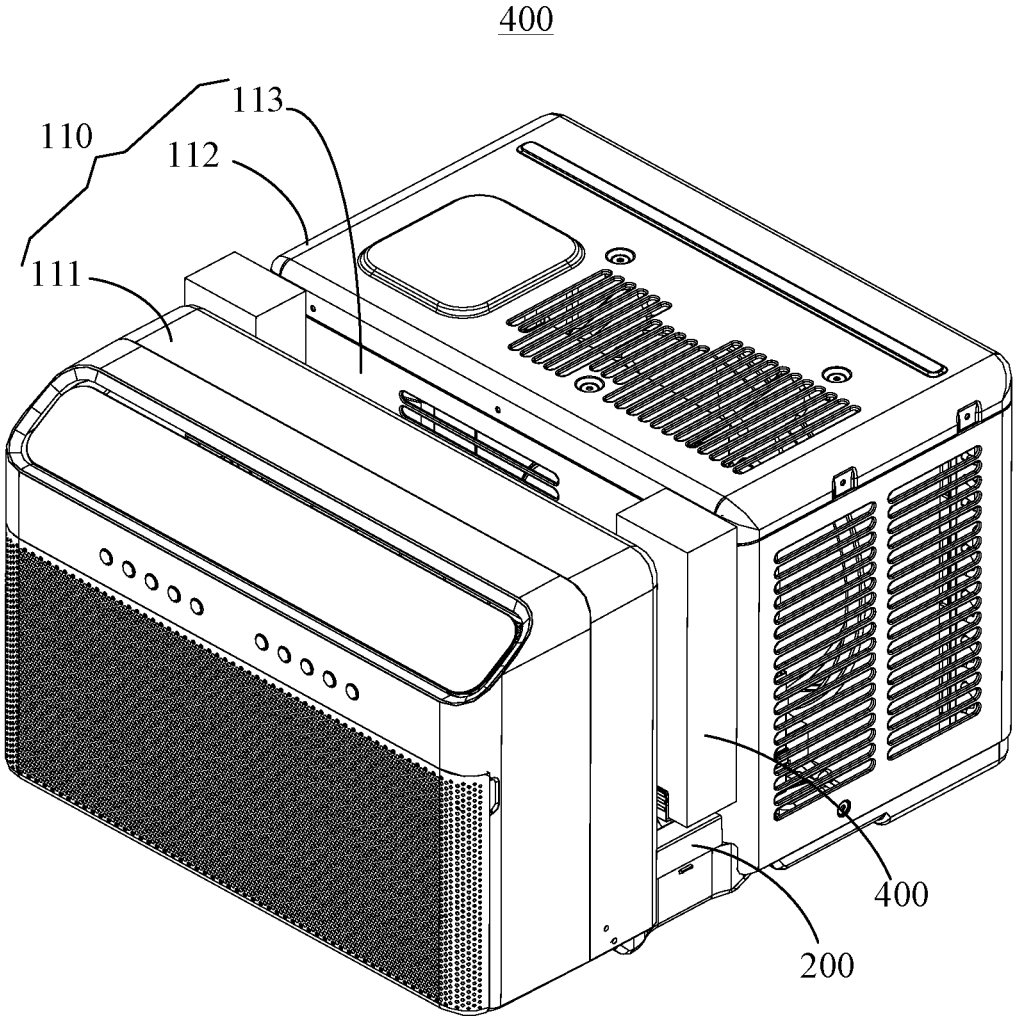
FIG. 16 is a schematic structural diagram of the window air conditioner with a seal in the storage state according to another embodiment of the present disclosure.

Referring to FIG. 2 and FIG. 4, based on any one of the above embodiments, the window air conditioner 100 further includes: a seal 400 movably mounted at the divider slot 113 and configured to extend from a lateral side of the divider slot 113 by moving for the shielding member 700 and/or an inner wall of the window frame 600 to abut against. That is, the seal 400 actually has a storage state and a working state. For the seal 400, in the storage state, it is stored in the divider slot 113 (as shown in FIG. 16); in the working state, the seal 400 extends from a lateral side of the divider slot 113 for the shielding member 700 and/or an inner wall of the window frame 600 to abut against (as shown in FIG. 17).

Specifically, after the window air conditioner 100 is mounted at the window frame 600, the seal 400 is moved to its working state, so that the seal 400 extends from a lateral side of the divider slot 113 of the window air conditioner 100, and a bottom surface of the seal 400 abuts against a bottom wall of the window frame 600. Then, the shielding member 700 is pulled down to extend into the divider slot 113 of the window air conditioner 100 until a lower edge of the shielding member 700 abuts against the divider 200 and the seal 400. The seal 400 shields and seals the gap between the shielding member 700 and the bottom wall of the window frame 600. When the window air conditioner 100 is not needed or is being transported, the seal 400 is moved to its storage state to reduce the occupied space and facilitates storage or packaging of the window air conditioner 100.

There are various ways for the movable installation of the seal 400. For example, the seal 400 is slidably provided at the divider 200; or, the seal 400 is rotatably provided at the divider 200; or, the seal 400 is elastically telescopically provided at the divider 200. Specifically, the seal 400 is rotatably provided at the divider 200 through a mounting base 500 to switch between its working state and storage state by rotation.

Figure 17:
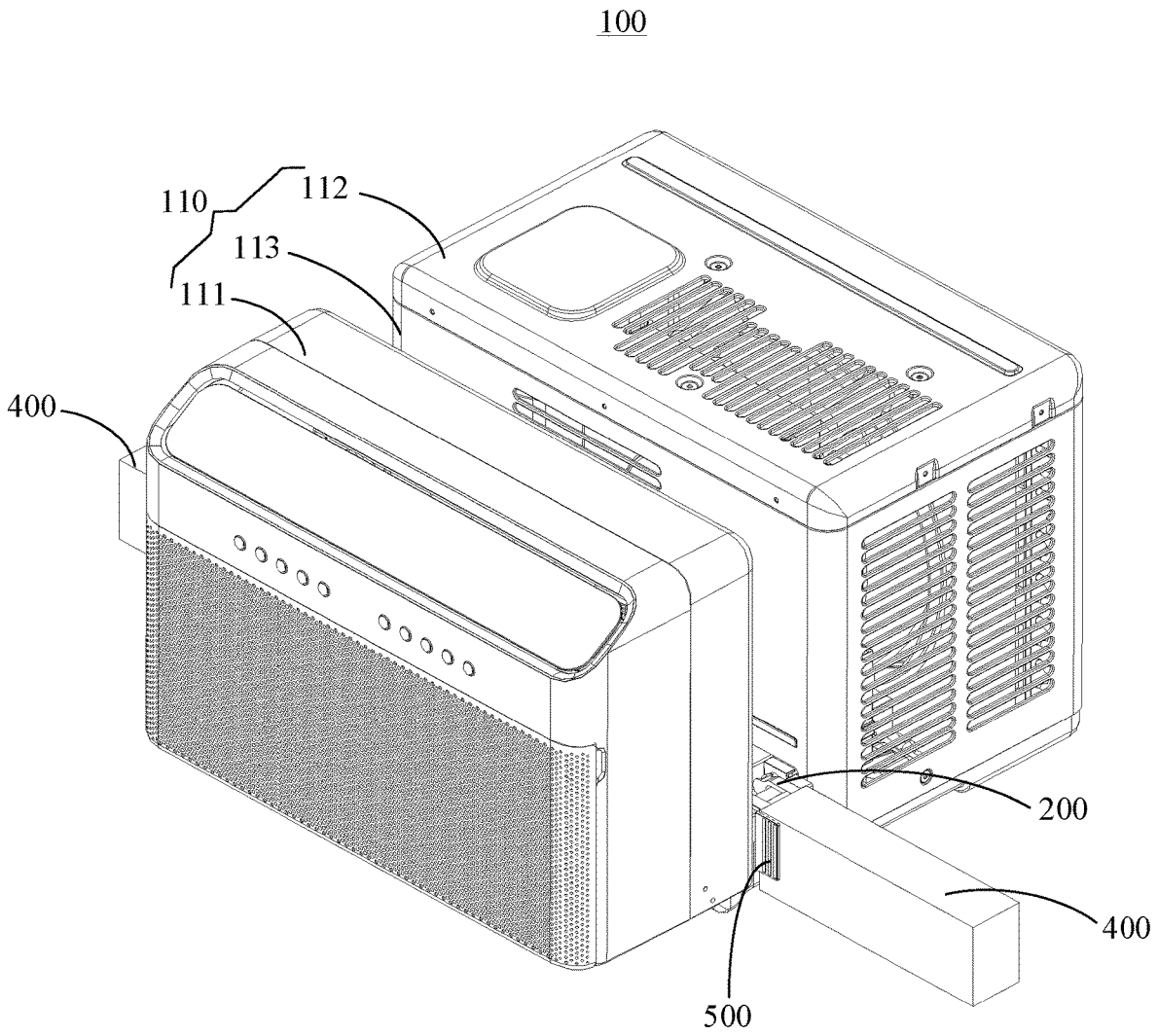
FIG. 17 is a schematic diagram showing the seal of the window air conditioner switched to the working state in FIG. 16.
Figure 18:
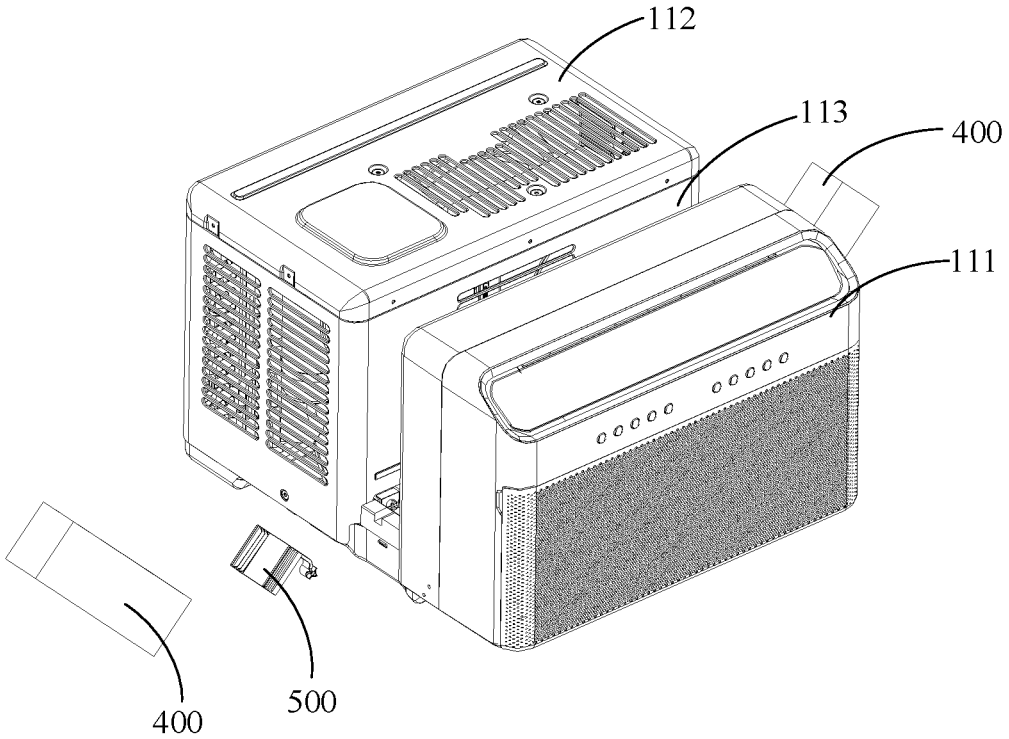
FIG. 18 is an exploded view of a part of the structure of the window air conditioner in FIG. 17 (the positioning member is in the storage state)

Referring to FIGS. 17 to 18, in an embodiment, the window air conditioner 100 further includes: a mounting base 500. The seal 400 is configured to be rotatably mounted at the divider slot 113 through the mounting base 500. The seal 400 is configured to be inserted into and connected with the mounting base 500. The seal 400 is configured to be fixed in an interference fit with the mounting base 500 through deformation.

Specifically, the seal 400 is provided in a long strip. The seal 400 has multiple sides, and the multiple sides have a large external surface area, which is beneficial to increasing the sealing surface. The seal 400 is inserted and connected to the mounting base 500, and no additional buckle or screw structure is needed, thereby the installation is convenient and simple. Since the seal 400 may be elastically or flexibly deformed, during the process of inserting and connecting the seal 400 and the mounting base 500, the seal 400 will be deformed flexibly or elastically, so that the insertion portion between the seal 400 and the mounting base 500 may be more tightly connected, thereby making it difficult for the seal 400 and the mounting base 500 to be separated, thereby achieving interference fit and fixing.

There are various design methods for the movable installation method of the mounting base 500, which are not specifically limited herein. For example, but not limited to: the mounting base 500 is slidably mounted at the divider slot 113; or the mounting base 500 is rotatably mounted at the divider slot 113; or the mounting base 500 is rollably mounted at the divider slot 113. It can be selected according to the difficulty of assembly. Specifically, the mounting base 500 is rotatably mounted at the divider slot 113.

Figure 19:
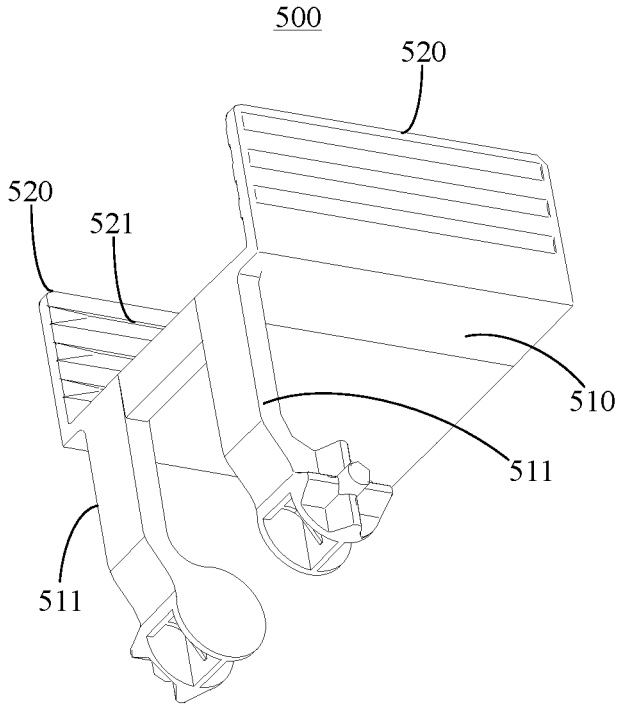
FIG. 19 is a schematic structural diagram of a mounting base in FIG. 18.
Figure 20:
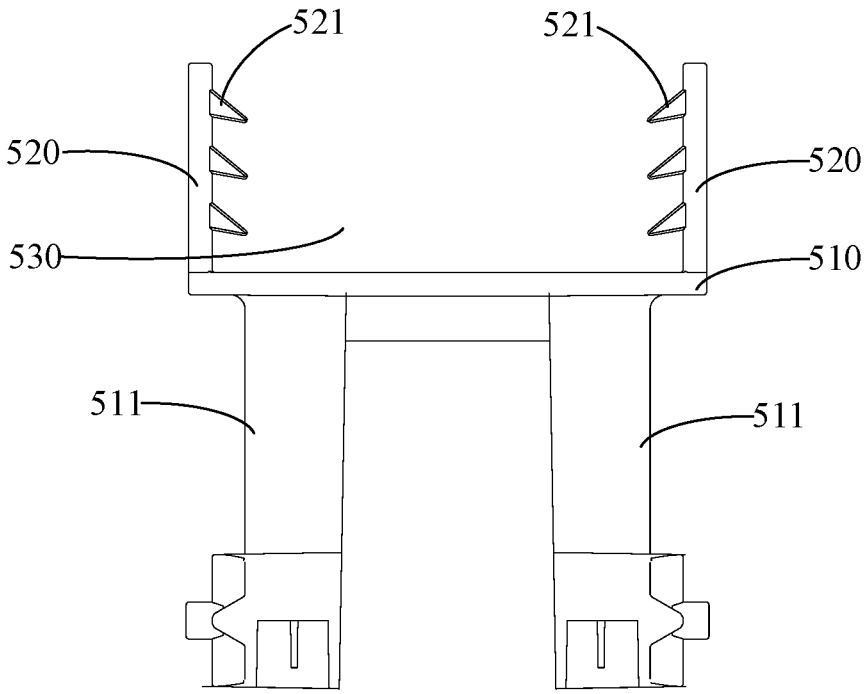
FIG. 20 is a schematic structural diagram of the mounting base in FIG. 19 from another perspective.

As shown in FIGS. 18 to 20, the mounting base 500 is rotatably mounted at the divider slot 113. Specifically, the mounting base 500 includes: a bottom plate 510, including: a rotation arm 511 rotatably connected with the divider slot 113 formed at one end of the bottom plate 510; and two side plates 520, one of the two side plates 520 being arranged at a side of the bottom plate 510, the other one of the two side plates 520 being arranged at the other opposite side of the bottom plate 510; and, where: the bottom plate 510 and the two side plates 520 are configured to define a mounting slot 530 for the seal 400 to be inserted into.

Specifically, the bottom plate 510 and the two side plates 520 of the mounting base 500 are enclosed to define a mounting slot 530, and the mounting slot 530 is in a substantially U-shape. One end of the mounting slot 530 defines an insertion opening. One end of the bottom plate 510 away from the insertion opening is rotatably mounted at the divider slot 113. When installing the seal 400 on the mounting base 500, first align one end of the seal 400 with the insertion opening of the mounting slot 530 on the mounting base 500, and then apply external force to the seal 400 to press the seal 400 into the mounting slot 530. During this process, the seal 400 is deformed by the pressing force of the inner wall of the mounting slot 530, so that the seal 400 is tightly squeezed into the mounting slot 530, and the seal 400 and the mounting base 500 are tightly fitted and not easy to separate, thereby the installation stability is better.

Please continue to refer to FIGS. 18 to 20. In an embodiment, in order to facilitate the insertion of the seal 400 into the mounting slot 530, a guide protrusion 521 may be protruding from an inner wall of at least one of the two side plates 520, and the guide protrusion 521 is configured to be in an elongated shape extending along an insertion direction of the mounting slot 530. The guide protrusion 521 may be integrally formed with the side plate 520. A number of the guide protrusion 521 may be plural, and the plurality of guide protrusions 521 may be arranged at intervals along a height direction of the side plate 520.

Therefore, in the process of inserting the seal 400 into the mounting slot 530, the guide protrusions 521 on the two side plates 520 cooperate to limit the insertion direction of the seal 400, so that the seal 400 is unlikely to be misaligned and deviate from the mounting slot 530, thereby ensuring that the seal 400 is accurately inserted into the mounting slot 530. In addition, since the guide protrusions 521 protrude from the inner wall of the side plate 520, the guide protrusions 521 on the two side plates 520 may cooperate to squeeze the seal 400, so that the seal 400 is prone to be deformed by compression and fit more tightly with the mounting base 500 and does not easily fall out of the mounting slot 530.

In order to ensure that the seal 400 may be deformed and inserted tightly with the mounting base 500, optionally, the seal 400 is made of a flexible material to be flexibly deformable; or the seal 400 is made of an elastic material to be elastically deformable. As for the specific material of the seal 400, it may be, but is not limited to, materials such as hard sponge, deformable plastic, rubber, or silicone. In the working state of the seal 400, when the shielding member 700 is pressed down to abut against the surface of the seal 400, the seal 400 will be deformed, so that the seal between the seal 400 and the shielding member 700 may be tighter. It is not prone to form a gap between the seal 400 and the shielding member 700, so that the sealing and waterproof effect is effectively enhanced.

In an embodiment, the window frames 600 are generally of different sizes, requiring the seals 400 of different lengths. Here, in order to adapt the seal 400 to the window frame 600 of different sizes, the seal 400 may also be cut to change the length. As mentioned above, the seal 400 is made of a flexible material or an elastic material, so that the seal 400 may have a good softness, so that the user may use the common cutting tools (such as daily knives) to cut the seal 400 to change its length to fit window frames 600 of different sizes.

As shown in FIG. 2 and FIG. 4, in an embodiment, because the strength of the seal 400 is relatively small and it may be bent and deformed excessively during the working process, the sealing effect of the seal 400 may be reduced. To avoid this situation, optionally, in the working state, the positioning member 300 is configured to abut against a top surface of the seal 400 and extend along a same extension direction as the seal 400 to press the seal 400 against the window frame 600.

Specifically, the extending direction of the positioning member 300 is consistent with the extending direction of the seal 400. The positioning member 300 abuts against the top surface of the seal 400, that is, the positioning member 300 and the lower frame edge of the window frame 600 cooperate to limit the seal 400, so that the seal 400 is not prone to bending, thereby effectively enhancing the strength of the seal 400, improving the stability of the seal 400 in the working state, and ensuring that the seal 400 may work normally and achieving sealing and waterproofing.

Further, in order to ensure the stability of the positioning member 300 abutting against the seal 400, the seal 400 includes a boss 410 which is arranged at the top surface of the seal 400, one lateral side of the boss 410 being flush with an inner side surface of the seal 400 for the shielding member 700 to abut against; and an accommodation slot 420 formed at the other opposite side of the boss 410, the accommodation slot 420 being configured for the positioning member 300 to pass through and be connected with the window frame 600.

Specifically, when the positioning member 300 is switched to its working state, the positioning member 300 sequentially passes through the accommodation cavity 210 of the divider 200, the avoiding slot 250, and the accommodation slot 420 of the seal 400, until the insertion connector 330 on the outer end of the positioning member 300 is inserted and connected to the insertion slot 610 of the window frame 600. At this time, the positioning member 300 is accommodated in the accommodation slot 420 of the seal 400, similar to the positioning member 300 passing through the inside of the seal 400. The positioning member 300 is blocked by the boss 410, so that the positioning member 300 is not prone to be misaligned with the seal 400, so as to closely abut against the inside of the accommodation slot 420. Since the positioning member 300 has a higher strength, the positioning member 300 plays a role in enhancing the strength of the seal 400, thereby effectively increasing the strength of the seal 400, and making it difficult to be bent.

In addition, since the positioning member 300 is blocked by the boss 410, the positioning member 300 may not be seen from the indoor room, so as to prevent the positioning member 300 from affecting the overall appearance of the window air conditioner 100. In addition, during the process of switching the positioning member 300 to its working state, the positioning member 300 is pulled out from the recess on the rear side of the boss 410, so as to be guided by the boss 410 and pulled out along the extension direction of the boss 410 and penetrate into the insertion slot 610 of the window frame 600, thereby realizing accurate inserting and connecting between the insertion connector 330 of the positioning member 300 and the insertion slot 610 of the window frame 600.

Figure 10:
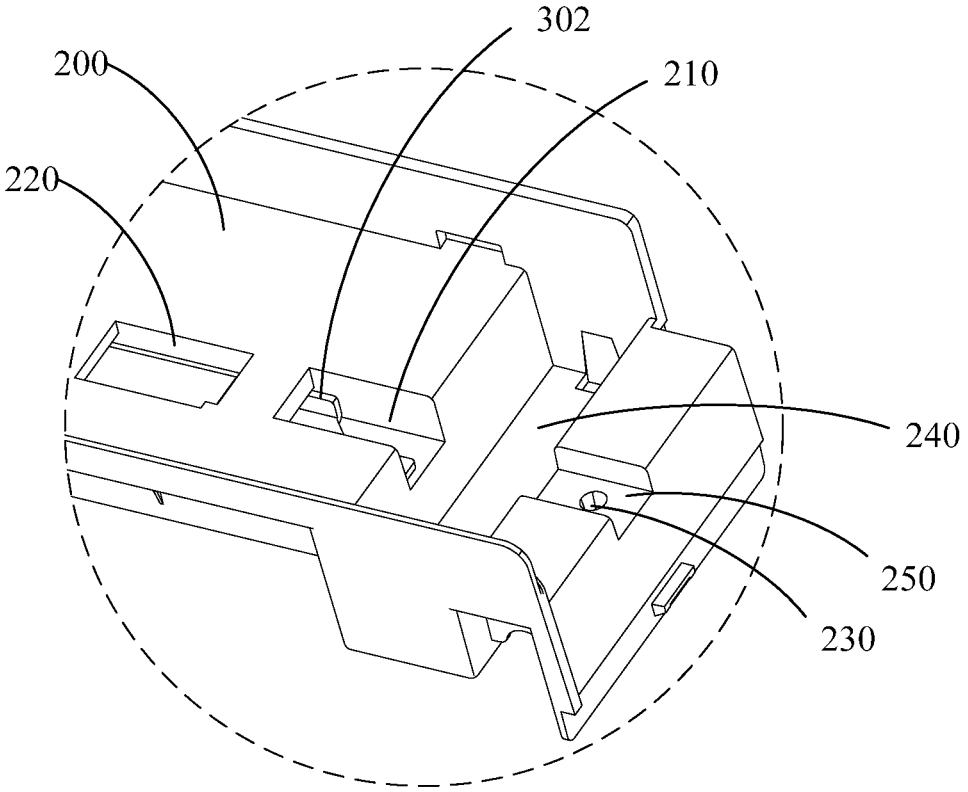
FIG. 10 is an enlarged view of a portion C in FIG. 9.

As shown in FIG. 4, FIG. 9, and FIG. 10, in an embodiment, in order to facilitate the installation of the seal 400, a sinker slot 240 is formed at an end of the divider 200 for the seal 400 to be movably installed. In order to prevent an outer side wall of the sink slot 240 from interfering with the drawing of the positioning member 300, optionally, an outer side wall of the sink slot 240 may be defined with an avoiding slot 250 corresponding to the accommodation cavity 210, and the avoiding slot 250 is configured to avoid the positioning member 300 when the positioning member 300 switches a state.

The above are only some embodiments of the present disclosure, and do not therefore limit the scope of the present disclosure. Under the concept of the present disclosure, any equivalent structural transformation made by using the contents of specification and attached drawings of the present disclosure, or directly/indirectly applied in other relevant technical fields, shall be included in the scope of the present disclosure.

What is claimed is:

1. A window air conditioner comprising:

a casing; and two positioning members provided at the casing, each of the two positioning members including:

a main plate; and two side edge plates arranged at two sides of the main plate, respectively, and forming a recess together with the main plate;

wherein:

the two positioning members are configured to be switchable between:

a storage state, in which the two positioning members are stored at the casing; and a working state, in which the two positioning members are at least partially outside the casing for positioning the casing; and in the storage state, the two positioning members are arranged in a stacked status in an up and down direction with one of the two side edge plates of one of the two positioning members being inserted in the recess of another one of the two positioning members.

2. The window air conditioner according to claim 1, wherein the two positioning members are configured to switch a state by rotation or sliding.

3. The window air conditioner according to claim 2, further comprising:

a divider slot formed at the casing;

wherein the two positioning members are mounted at the divider slot.

4. The window air conditioner according to claim 1, further comprising:

a divider slot formed at the casing;

wherein the two positioning members are mounted at the divider slot and are configured to be stored in the divider slot in the storage state.

5. The window air conditioner according to claim 4, further comprising:

a divider provided at a bottom of the divider slot and including an accommodation cavity extending in a length direction of the divider and with openings at two ends of the accommodation cavity, respectively;

wherein the two positioning members are pullably mounted at the accommodation cavity and configured to slide into and out of the accommodation cavity through at least one of the openings.

6. The window air conditioner according to claim 5, wherein:

the two positioning members are configured to slide into and out of the accommodation cavity through from the two ends of the accommodation cavity, respectively.

7. The window air conditioner according to claim 6, wherein:

one of the two positioning members includes a cavity; and in the storage state, the two positioning members are arranged in the stacked status in an inner and outer direction with another one of the two positioning members being inserted in the cavity of the one of the two positioning members.

8. The window air conditioner according to claim 5, wherein:

the accommodation cavity is formed inside the divider; and the divider is hollowed in a top wall of the accommodation cavity to form see through openings.

9. The window air conditioner according to claim 5, wherein:

the divider has an alignment hole at an end;

one of the two positioning members has positioning holes arranged at intervals along a length direction of the one of the two positioning members; and the one of the two positioning members is configured to be fixed at the casing by a connector sequentially passing through the alignment hole and one of the positioning holes.

10. The window air conditioner according to claim 9, wherein each of the positioning holes is configured to be in an elongated shape extending along the length direction of the one of the two positioning members.

11. The window air conditioner according to claim 4, further comprising:

a seal movably mounted at the divider slot and configured to extend from a lateral side of the divider slot by moving.

12. The window air conditioner according to claim 11, further comprising:

a mounting base;

wherein the seal is configured to be:

rotatably mounted at the divider slot through the mounting base;

inserted into and connected with the mounting base; and fixed in an interference fit with the mounting base through deformation.

13. The window air conditioner according to claim 12, wherein the mounting base includes:

a bottom plate including a rotation arm formed at one end of the bottom plate and rotatably connected with the divider slot; and two side plates arranged at two sides of the bottom plate, respectively, and, together with the bottom plate, forming a mounting slot for the seal to be inserted into.

14. The window air conditioner according to claim 13, further comprising:

a guide protrusion protruding from an inner wall of one of the two side plates, the guide protrusion being configured to be in an elongated shape extending along an insertion direction of the mounting slot.

15. The window air conditioner according to claim 12, wherein:

the seal is made of a flexible material to be flexibly deformable; or the seal is made of an elastic material to be elastically deformable.

16. The window air conditioner according to claim 11, wherein in the working state, the two positioning members abut against a top surface of the seal and ex-tends extend along a same extension direction as the seal to press the seal against a lower portion of a window frame.

17. The window air conditioner according to claim 16, wherein the seal includes:

a boss arranged at the top surface of the seal, one lateral side of the boss being flush with an indoor side surface of the seal, the two positioning members being arranged at another lateral side of the boss that is opposite to the one lateral side of the boss.

18. The window air conditioner according to claim 11, further comprising:

a sink slot formed at an end of the divider in the divider slot and configured for the seal to be movably mounted; and an avoiding slot formed at an outer side wall of the sink slot and corresponding to the mounting slot, the avoiding slot being configured to avoid the two positioning members when the two positioning members switch a state.

19. The window air conditioner according to claim 1, further comprising:

an insertion connector formed at an end of one of the two positioning members.

* * * * *